US010276931B1

(12) United States Patent
Wunsch

(10) Patent No.: US 10,276,931 B1
(45) Date of Patent: Apr. 30, 2019

(54) PANEL ANTENNA WITH CORRUGATED ARMS FOR REDUCED PROFILE

(71) Applicant: BAE SYSTEMS Information and Electronic Systems Integration Inc., Nashua, NH (US)

(72) Inventor: Gregory J. Wunsch, Milford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 15/840,387

(22) Filed: Dec. 13, 2017

(51) Int. Cl.

| | |
|---|---|
| ***H01Q 11/12*** | (2006.01) |
| ***H01Q 1/38*** | (2006.01) |
| ***H01Q 13/12*** | (2006.01) |
| ***H01Q 5/25*** | (2015.01) |
| ***H01Q 9/04*** | (2006.01) |
| ***H01Q 11/14*** | (2006.01) |
| *H01Q 5/357* | (2015.01) |
| *H01Q 13/10* | (2006.01) |
| *H01Q 5/378* | (2015.01) |
| *H01Q 1/24* | (2006.01) |
| *H01Q 1/22* | (2006.01) |
| *H01Q 7/00* | (2006.01) |

(52) U.S. Cl.
CPC ..... *H01Q 1/38* (2013.01); *H01Q 5/25* (2015.01); *H01Q 9/0442* (2013.01); *H01Q 11/14* (2013.01); *H01Q 13/12* (2013.01); *H01Q 1/22* (2013.01); *H01Q 1/242* (2013.01); *H01Q 5/357* (2015.01); *H01Q 5/378* (2015.01); *H01Q 7/00* (2013.01); *H01Q 9/0421* (2013.01); *H01Q 13/10* (2013.01)

(58) Field of Classification Search
CPC ..... H01Q 7/00; H01Q 1/242; H01Q 13/10; H01Q 1/22; H01Q 5/378
USPC ..... 343/742, 702, 700, 770, 720, 767, 912
See application file for complete search history.

(56) References Cited

U.S. PATENT DOCUMENTS

| | | | |
|---|---|---|---|
| 3,689,929 | A | 9/1972 | Moody |
| 5,790,080 | A | 8/1998 | Apostolos |
| 6,127,983 | A | 10/2000 | Rivera |
| 6,373,440 | B2 | 4/2002 | Apostolos |
| 6,518,931 | B1 | 2/2003 | Sievenpiper |
| 7,046,199 | B2 | 5/2006 | Montgomery |
| 8,228,251 | B1 | 7/2012 | Behdad |
| 8,558,741 | B2 | 10/2013 | Baliarda |

(Continued)

*Primary Examiner* — Joseph J Lauture
(74) *Attorney, Agent, or Firm* — Finch & Maloney, PLLC

(57) ABSTRACT

A reduced profile panel antenna is disclosed. A panel antenna configured according to an embodiment includes two opposing antenna arms disposed over a ground plane. The antenna arms include one or more corrugated or folded sections to increase the electrical path of the antenna arms within fixed physical dimensions (e.g., length and width) of the panel antenna. The panel antenna also includes passive filters to provide current loop paths of varying lengths for selected frequency ranges. Longer loop paths are employed for signals at lower frequencies (i.e., longer wavelengths) and shorter loop paths are employed for signals at higher frequencies (i.e., shorter wavelengths). The panel antenna further includes a ferrite plane disposed between the ground plane and the antenna arms to suppress radio frequency (RF) signal reflections and allow for a reduced antenna profile or thickness.

20 Claims, 9 Drawing Sheets

(56) References Cited

U.S. PATENT DOCUMENTS

2008/0048923 A1* 2/2008 Tammisetti ..... H01Q 3/04
343/776

* cited by examiner

PANEL ANTENNA WITH CORRUGATED ARMS FOR REDUCED PROFILE

STATEMENT OF GOVERNMENT INTEREST

This invention was made with United States Government assistance under Contract No. W56HZV-15-C-0133 awarded by US Army Contracting Command. The United States Government has certain rights in this invention.

FIELD OF DISCLOSURE

The present disclosure relates to antennas, and more particularly, to wideband panel antennas with corrugated arms to provide a reduced profile.

BACKGROUND

Typically, the size of an antenna is related, at least in part, to the frequency range or wavelength of the signals of interest that are to be transmitted or received. For example, radio signals in the very high frequency (VHF) range of 30 to 300 MHz have wavelengths between 1 and 10 meters. Thus, VHF antennas, for example whip antennas, tend to be several feet long in order to approximately match one half to one quarter of the wavelength of the signal, depending on the design.

VHF radios are commonly used for communication systems in vehicles, tanks, helicopters, etc. The relatively long antennas, however, can be problematic and vulnerable, particularly in hostile environments, as they tend to protrude from the vehicle structure. These lengthy antennas can also present aerodynamic challenges for helicopters and other aircraft. Additionally, such antennas can reduce the effectiveness of vehicle concealment techniques.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts.

Although the following Detailed Description will proceed with reference being made to illustrative embodiments, many alternatives, modifications, and variations thereof will be apparent to those skilled in the art.

DETAILED DESCRIPTION

Panel antennas are disclosed that provide wideband performance at longer wavelengths in a reduced form factor. The disclosed antennas employ corrugated or folded sections to increase the electrical path length of the antenna, to efficiently transmit and receive longer wavelength signals, while still fitting within a constrained space. In some embodiments, the antenna includes two opposing antenna arms disposed over a ground plane. The antenna arms may be mirror images of each other and may include one or more corrugated sections to increase the electrical path of the antenna arms within fixed physical dimensions (e.g., length, width). The panel antenna also includes passive filters that create current loop paths of varying lengths for selected frequency ranges by shunting sections of the antenna arms for those frequency ranges, as will be described in greater detail below, according to an embodiment. Longer loop paths are employed for signals at lower frequencies (i.e., longer wavelengths) and shorter loop paths are employed for signals at higher frequencies (i.e., shorter wavelengths). The use of multiple signal loop paths of different electrical lengths enables the antenna panel to handle signals in a wider bandwidth with greater efficiency or gain than would otherwise be possible. The use of passive filters provides for wider instantaneous bandwidth by eliminating the delays associated with switching and tuning. This can be advantageous in many applications including, for example, frequency hopping. The panel antenna further includes a ferrite plane disposed between the ground plane and the antenna arms to suppress radio frequency (RF) signal reflections and to allow for a reduced antenna profile or thickness.

The disclosed panel antenna can be employed, for example, on a vehicle, an airborne platform, a guided munition, or in other applications where size constraints may be imposed, to provide RF communications in VHF frequency bands or other longer wavelength communication systems. As will be appreciated in light of this disclosure, the panel antennas described herein may allow for improved signal transmission and reception compared to existing antennas of similar physical size but of smaller electrical dimension, which are not suitably matched to work with longer wavelength signals. Additionally, the disclosed panel antennas provide an improved form factor compared to, for example, longer whip antennas which attempt to match the longer wavelength signals.

Figure 1:
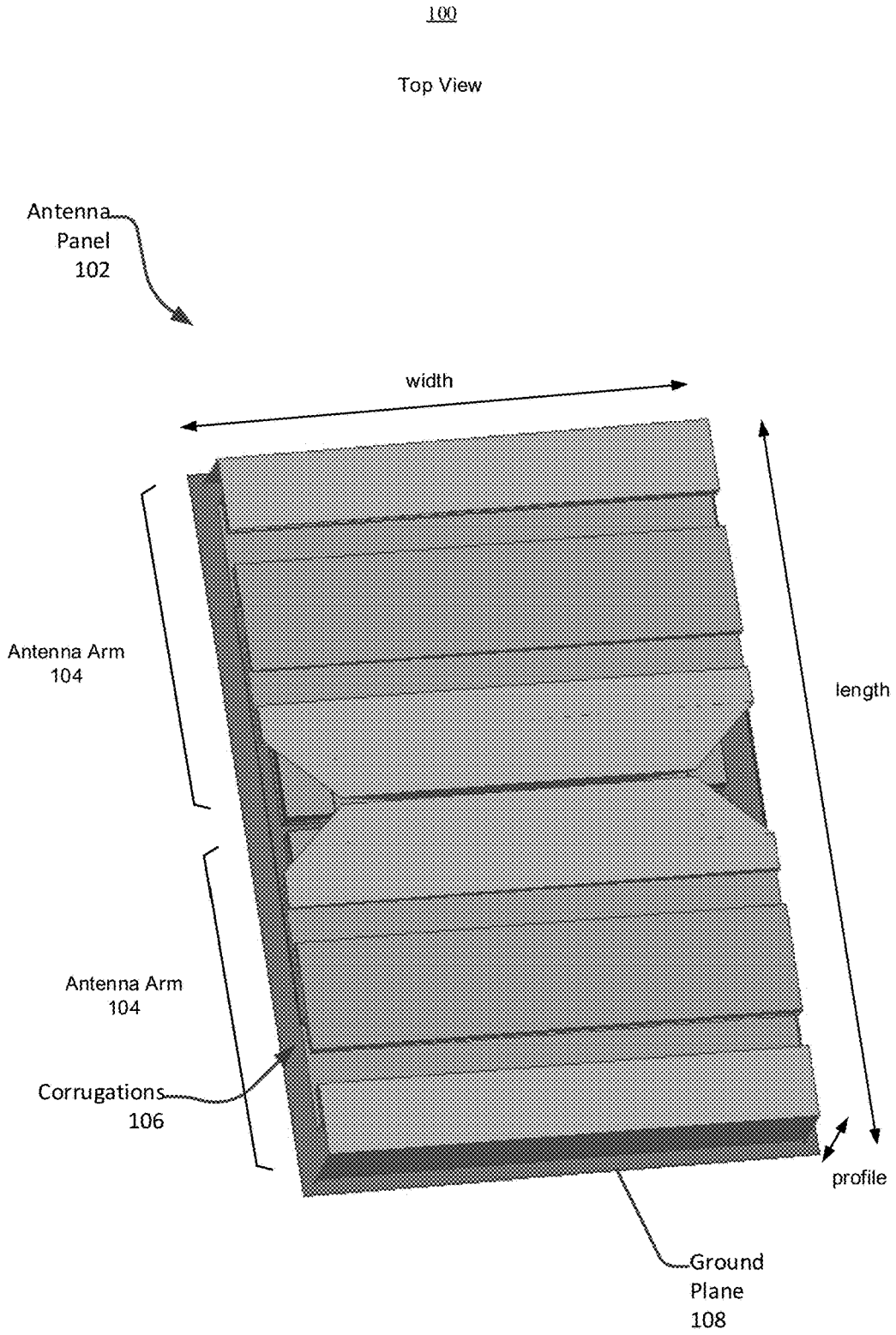
FIG. 1 illustrates a top view of an antenna panel, configured in accordance with certain embodiments of the present disclosure.

FIG. 1 illustrates a top view 100 of an antenna panel 102, configured in accordance with certain embodiments of the present disclosure. The dimensions of the antenna are indicated for reference as width, length and profile (or thickness). The antenna panel is shown to include two antenna arms 104 which are mirror images of each other in this embodiment, although that is not a requirement in general. A ground plane 108 is also visible, upon which the antenna arms are disposed. A number of corrugations or folds 106 in the antenna arm can just be discerned in this top view illustration.

Figure 2:
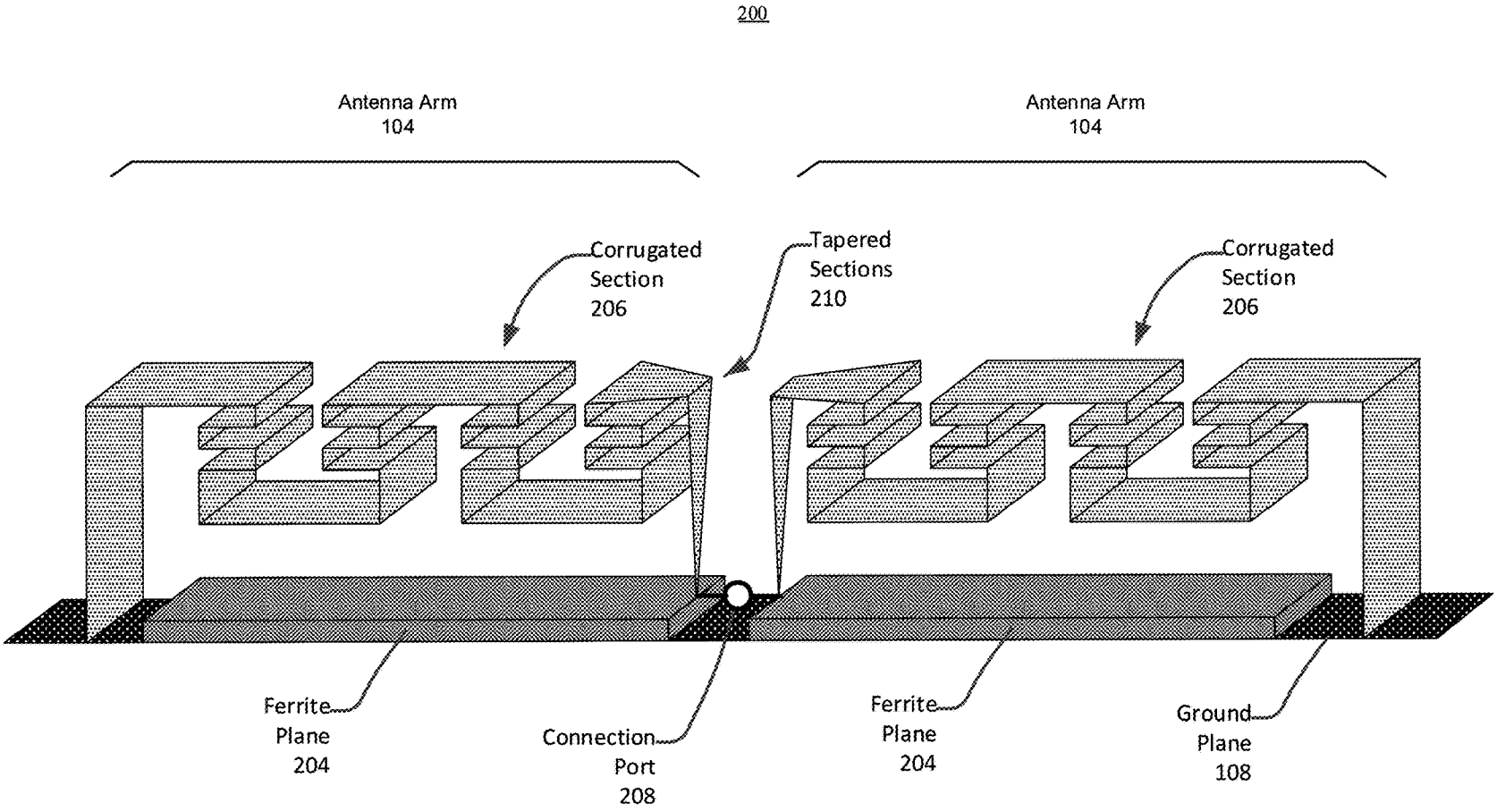
FIG. 2 illustrates a perspective view of the antenna panel, configured in accordance with certain of the embodiments disclosed herein.

FIG. 2 illustrates a perspective view 200 of the antenna panel, configured in accordance with certain of the embodiments disclosed herein. Antenna arms 104 are shown to include a number of corrugated sections 206, not all of which are labeled, for simplicity. The corrugated sections 206 allow for an increased electrical path length of the antenna arms within a fixed physical length of the antenna panel. The corrugations or folds are not drawn to scale, and various embodiments may employ any desired number of corrugated sections, including any number of folds, of any suitable dimension. The number and dimensions of the folds may be based on the desired electrical path length as well as on the physical length constraints of the antenna panel. Additionally, the folds need not be restricted to right angle bends as shown, but rather may be implemented using any other suitable geometric configuration, such as, for example, a zig-zag or accordion style, according to other embodiments.

Also shown in view 200 are the ground plane 108, and planar ferrite structures 204 which are disposed between the ground plane and each of the antenna arms. The ferrite structures 204 function as an absorber of electromagnetic radiation and are configured to suppress RF signal reflections from the ground plane. Such reflections can cause destructive interference in the direction of the main antenna beam when the arms are positioned less than a quarter of a wavelength above the ground plane, with the interference becoming more severe the closer the arms are to the ground plane. Use of these ferrite structures allows for a reduced antenna profile or thickness, with minimal reduction and antenna performance. In some embodiments, the profile may be on the order of 1/100 of the signal wavelength at the lowest operational frequency. In some embodiments, other RF absorbing materials or structures may also be used, such as, for example, high permeability and low weight "meta-materials," or carbon loaded foam. Additionally, frequency selective structures that can redirect the interference in directions other than the main antenna beam may also be used instead of, or in conjunction with the ferrite structures.

As can further be seen in view 200, the antenna arms 104 taper down in width, over tapered sections 210, to meet and couple with the connection port 208 or another suitable signal feed. The tapering is configured to reduce impedance mismatch between the antenna arms and the connection port, which could otherwise cause undesired signal reflections.

Figure 3:
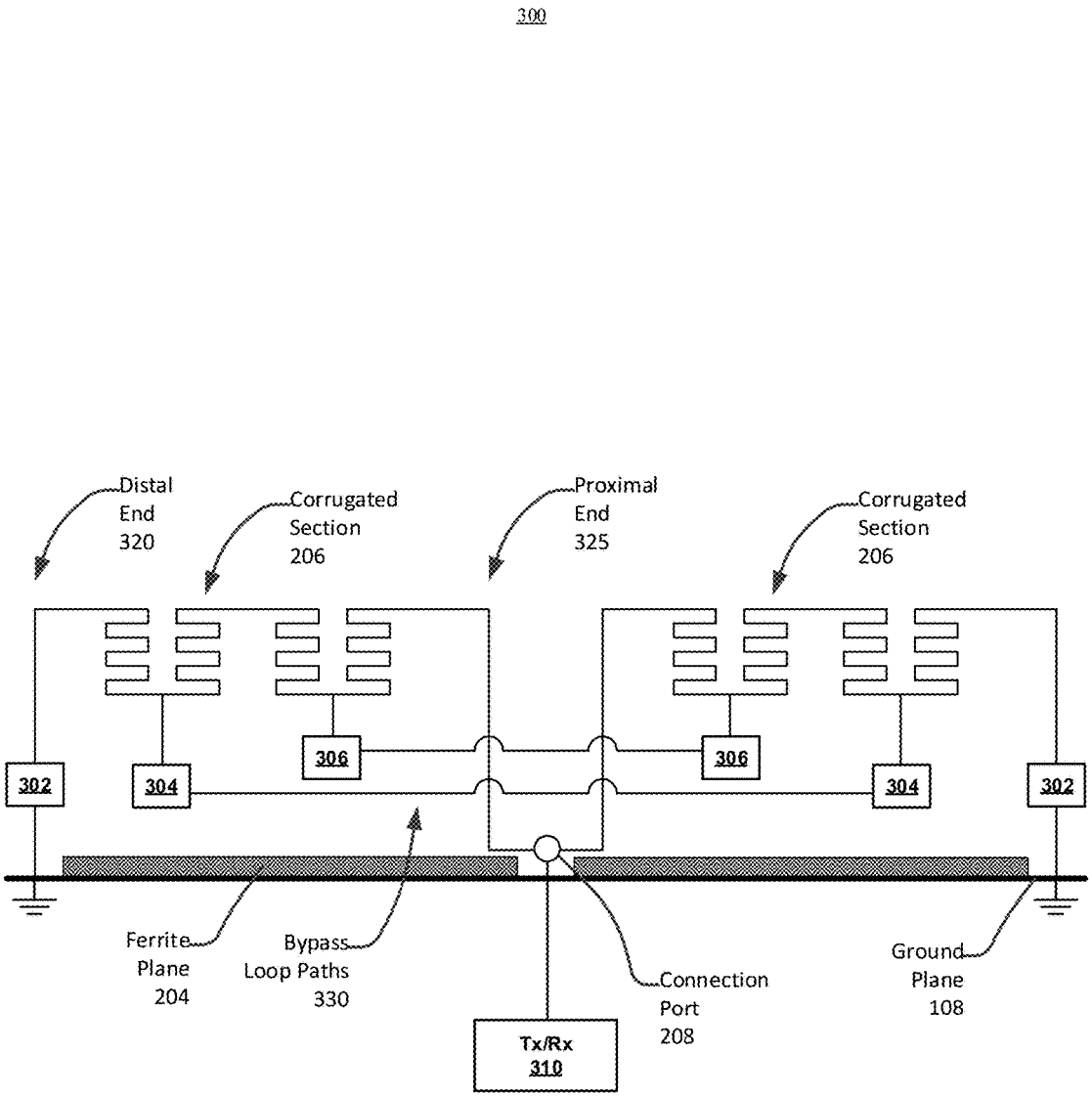
FIG. 3 illustrates a side view of the antenna panel, configured in accordance with certain of the embodiments disclosed herein.

FIG. 3 illustrates a side view 300 of the antenna panel, configured in accordance with certain of the embodiments disclosed herein. Further details, including filters 302, 304, and 306, along with bypass loop paths 330, are shown in this Figure and will be described in greater detail below. Additionally, the proximal end 325 and distal end 320 of the antenna arms are labeled in this figure, for one of the arms, as an aid in the further description of the disclosed antenna panel. As can be seen, the proximal end 325 of the arm is closest to the connection port 208, while the distal end 320 is furthest away from the connection port. Connection port 208 is configured as a coupling mechanism between the antenna arms and transceiver 310 (e.g., transmitter and/or receiver circuits). In some embodiments, the distance from the distal end to the proximal end of the antenna arms (i.e., the length of each of the antenna arms) is approximately one quarter of the wavelength of the lowest frequency signal of interest (i.e., one quarter of the longest wavelength signal of interest).

Filters 302, 304, and 306 are configured as bandpass, lowpass, and/or highpass filters to pass signals (e.g., signal currents) within selected frequency ranges that are associated with each filter. Thus, for example, filter 306 allows signals within a given frequency range to pass through the filter and be diverted through one of the bypass loop paths 330. This has the effect of bypassing the remaining distal portions of the antenna arm, for signals at those frequencies, which creates a shorter antenna loop for those signals, as will be described in connection with FIGS. 4-6 below.

In some embodiments, filters 302, 304, and 306 are implemented as passive filters, for example as resistor-capacitor (RC) circuit networks where the values of R and C as well as the configuration (e.g., serial or parallel) determine the frequency ranges for which the filter will pass signals. It will be appreciated that these passive filters generally benefit from low loss characteristics that can reduce undesirable resonance in the signals. Additionally, these filters provide resistive coupling of the distal ends of the antenna arms to the ground plane to improve the voltage standing wave ratio of the signals and thus the efficiency of the antenna.

Figure 4:
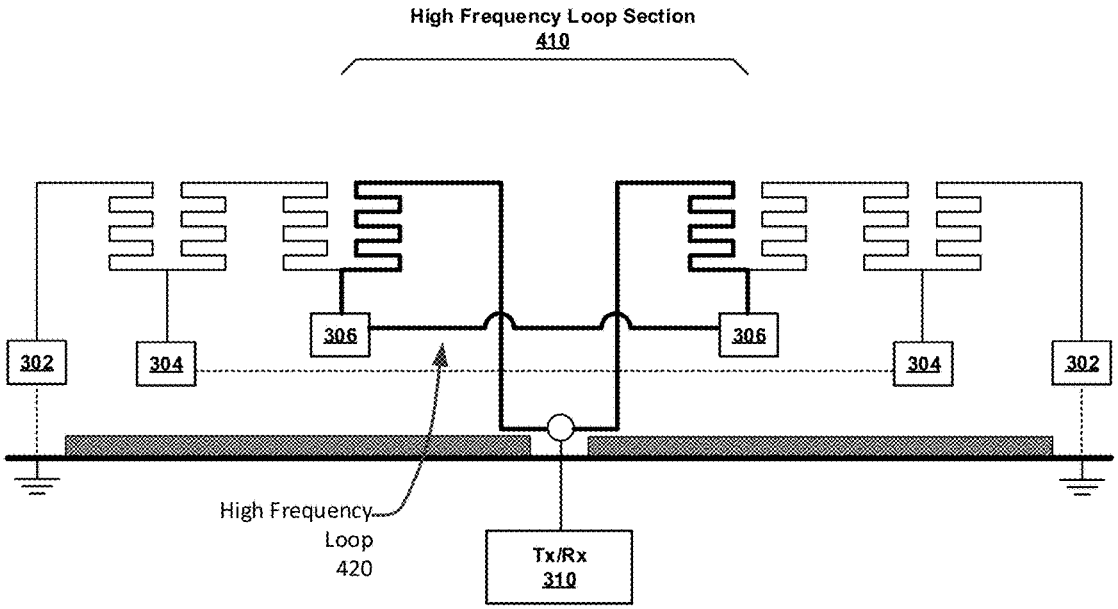
FIG. 4 illustrates a high frequency range loop section of the antenna panel, configured in accordance with certain of the embodiments disclosed herein.

FIG. 4 illustrates a high frequency range loop section 410 of the antenna panel, configured in accordance with certain of the embodiments disclosed herein. In this example, filter 306 is configured to pass signals that are within a relatively higher frequency range of the total frequency range for which the antenna is designed to operate. For example, if the antenna is designed to operate in the VHF range of 30 to 300 MHz, filter 306 may be configured to pass signals in the 100 to 300 MHz range. These higher frequency signals will therefore be shunted predominantly through the high frequency loop 420, indicated by the bolder line, resulting in an antenna loop having an effectively shorter electrical length compared to the entire antenna panel. In this case, the antenna functions as a loaded loop. The shorter electrical loop will be better matched to the reception and transmission of such higher frequency signals, allowing for increased reception and transmission efficiency or gain.

Figure 5:
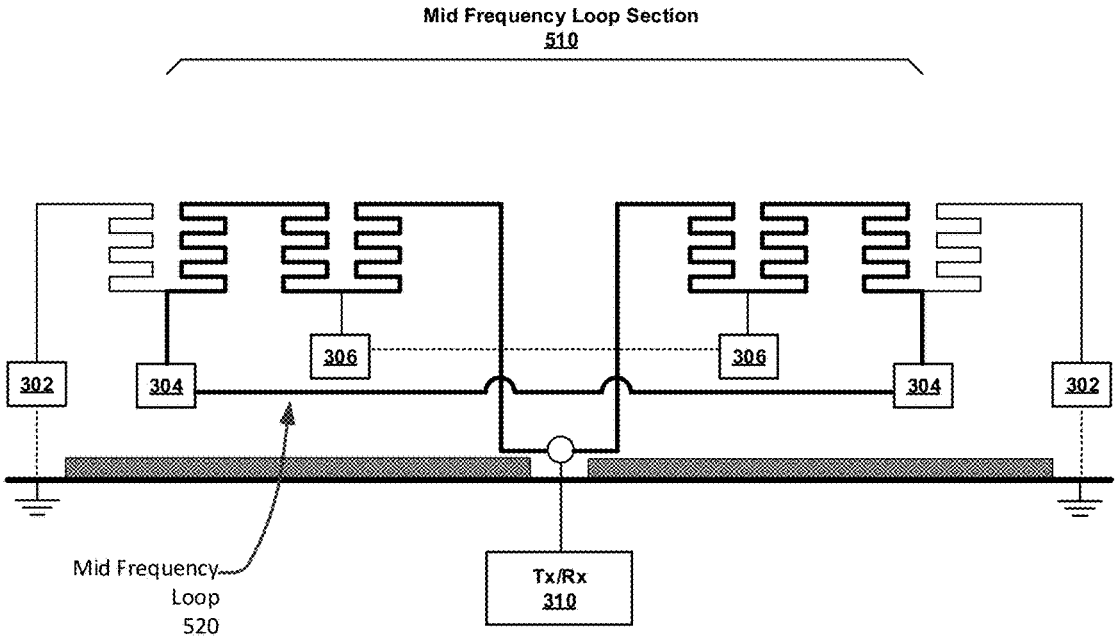
FIG. 5 illustrates a medium frequency range loop section of the antenna panel, configured in accordance with certain of the embodiments disclosed herein.

FIG. 5 illustrates a medium frequency range loop section 510 of the antenna panel, configured in accordance with certain of the embodiments disclosed herein. In this example, filter 304 is configured to pass signals that are within a mid-frequency range of the total frequency range for which the antenna is designed to operate. For example, if the antenna is again designed to operate in the VHF range of 30 to 300 MHz, filter 304 may be configured to pass signals in the 50 to 100 MHz range. These medium frequency signals will therefore be shunted predominantly through the mid-frequency loop 520, indicated by the bolder line, resulting in an antenna loop having an effectively shorter electrical length compared to the entire antenna panel, but longer than the high frequency loop 420 described above. The medium length electrical loop will be better matched to the reception and transmission of such mid-frequency signals, allowing for increased reception and transmission efficiency.

Figure 6:
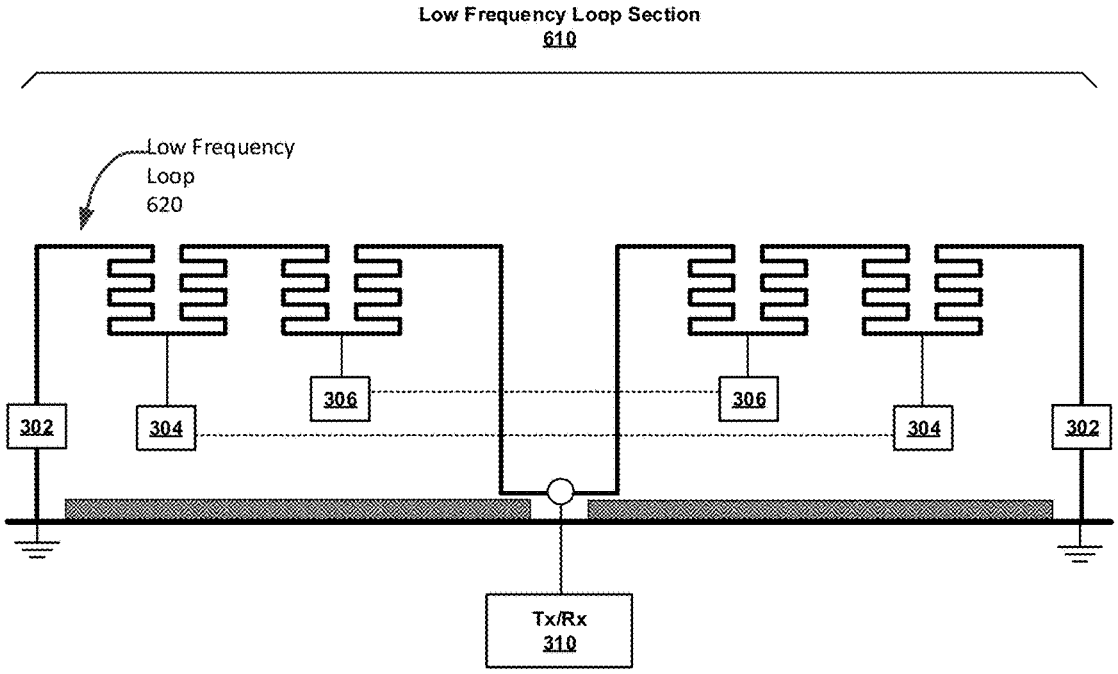
FIG. 6 illustrates a low frequency range loop section of the antenna panel, configured in accordance with certain of the embodiments disclosed herein.

FIG. 6 illustrates a low frequency range loop section 610 of the antenna panel, configured in accordance with certain of the embodiments disclosed herein. In this example, filter 302 is configured to pass signals that are within a lower frequency range of the total frequency range for which the antenna is designed to operate. For example, if the antenna is again designed to operate in the VHF range of 30 to 300 MHz, filter 302 may be configured to pass signals in the 30 to 50 MHz range. These lower frequency signals will therefore be shunted predominantly through the low frequency loop 620, indicated by the bolder line, resulting in an antenna loop having an effectively longer electrical length comprising substantially the entire antenna panel. As can be seen, the low frequency loop includes the ground plane 108. In this case the antenna functions as an end loaded dipole. The longer electrical loop will be better matched to the reception and transmission of such low frequency signals, allowing for increased reception and transmission efficiency.

Although three different loop sections 410, 510, and 610 (along with associated filters 306, 304, 302) are shown in the example above, it will be appreciated that other embodiments may employ a greater or fewer number of loop sections and filters matched to any desired frequency ranges.

The use of multiple signal loop paths of different electrical lengths enable the antenna panel to simultaneously handle signals in a wider bandwidth with greater efficiency or gain than would otherwise be possible. One reason for this is that, typically, there are portions of the frequency band where signal dropouts can occur due to resonances. Typically, favorable resonances (that improve the impedance match), alternate in the frequency spectrum with other resonances (sometimes referred to as anti-resonances) which tend to negate the impedance match. The loss, in the low loss filter, tends to reduce the match at the favorable impedance matches, while improving the match at these anti-resonances. The low loss passive filters are designed to bypass the corrugated sections of the antenna arms in a manner that tends to even out the impedance match over that portion of the band, without dissipating an excessive amount of power, which would have the effect of reducing the performance of the antenna. It should be noted that the bypass of the corrugated sections, described above, does not occur abruptly at a given frequency, but rather attempts to smoothly transition throughout the entire frequency band.

Figure 7:
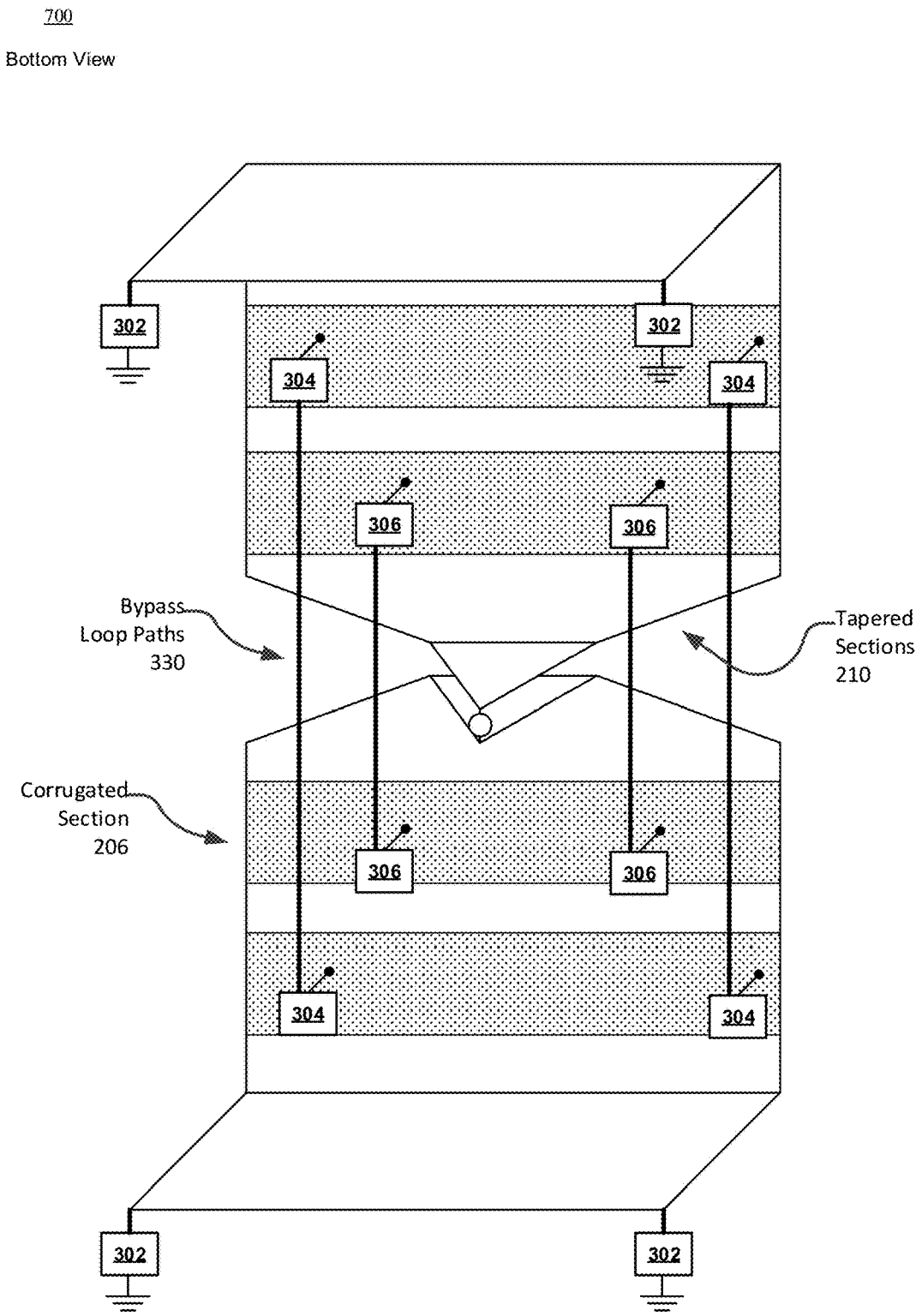
FIG. 7 illustrates a bottom view of the antenna panel, configured in accordance with certain of the embodiments disclosed herein.

FIG. 7 illustrates a bottom view 700 of the antenna panel, configured in accordance with certain of the embodiments disclosed herein. In this Figure, the corrugated sections 206 are indicated simply as shaded regions, and the ground plane 108 and ferrite plane 204 have been omitted, to simplify the drawing and improve clarity. As can be seen in this illustration, multiple instances of each filter 302, 304, 306, along with an associated bypass loop path 330, may be employed in the antenna panel. In this example, the filters are duplicated on each side of the antenna panel, although other configurations are possible. For example, in a wider antenna panel, additional filters and bypass loop paths may be employed, while a narrower antenna panel may use just one set of filters and loop paths.

The width of the panel antenna can be chosen based on a trade-off between physical size and bandwidth capability. Wider antenna arms can more efficiently handle greater instantaneous bandwidths due to their inherent impedance match advantages. In some embodiments, the width of the corrugated or folded sections are uniform throughout the antenna arm, with the exception of the tapered sections 210, to further limit undesired signal reflections for wideband use.

Figure 8:
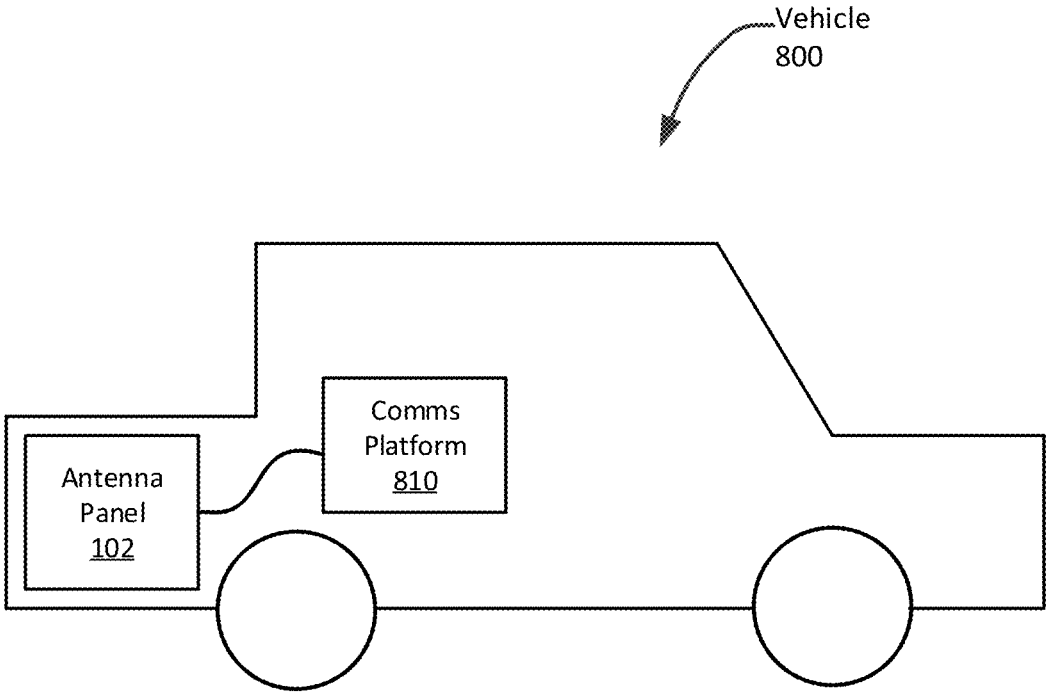
FIG. 8 illustrates an application of the antenna panel on a vehicle, in accordance with certain of the embodiments disclosed herein.

FIG. 8 illustrates an application of the antenna panel 102 on a vehicle 800, in accordance with certain of the embodiments disclosed herein. The antenna panel 102 is shown mounted on the side of the vehicle 800, which may be a truck, tank, personnel carrier, helicopter or any other vehicle whether land-based or airborne. The antenna panel 102 is coupled to a communications platform 810, as described below, which in some embodiments may be located inside the vehicle. In some embodiments, the antenna panel 102 may be configured to appear, or be disguised as, an architectural panel. In some embodiments, arrays comprising multiple such antenna panels may also be deployed.

Example Platform

Figure 9:
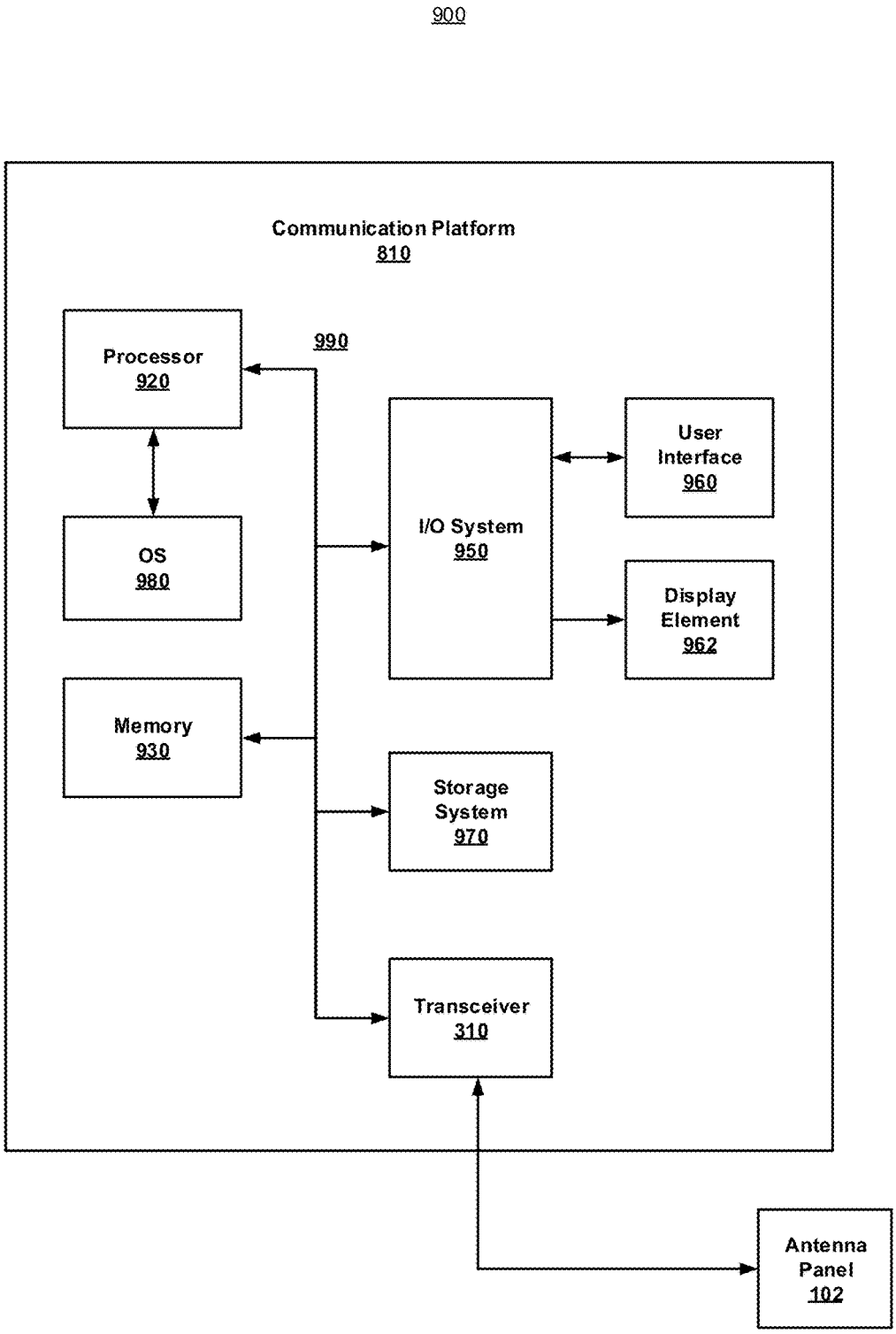
FIG. 9 is a block diagram schematically illustrating a communication platform employed with the antenna panel, in accordance with certain of the embodiments disclosed herein.

FIG. 9 is a block diagram 900 schematically illustrating the communication platform 810 employed with the antenna panel 102, in accordance with certain of the embodiments disclosed herein. In some embodiments, communications platform 810 may be hosted on, or otherwise be incorporated into, a radio, data communication device, personal computer, workstation, laptop computer, tablet, portable computer, and so forth. Any combination of different devices may be used in certain embodiments.

In some embodiments, platform 810 may comprise any combination of a processor 920, a memory 930, a transceiver 310, an input/output (I/O) system 950, a user interface 960, a display element 962, and a storage system 970. As can be further seen, a bus and/or interconnect 990 is also provided to allow for communication between the various components listed above and/or other components not shown. Other componentry and functionality not reflected in the block diagram of FIG. 9 will be apparent in light of this disclosure, and it will be appreciated that other embodiments are not limited to any particular hardware configuration.

Processor 920 can be any suitable processor, and may include one or more coprocessors or controllers, such as an audio processor, a graphics processing unit, or hardware accelerator, to assist in control and processing operations associated with platform 810. In some embodiments, the processor 920 may be implemented as any number of processor cores. The processor (or processor cores) may be any type of processor, such as, for example, a microprocessor, an embedded processor, a digital signal processor (DSP), a graphics processor (GPU), a network processor, a field programmable gate array or other device configured to execute code. The processors may be multithreaded cores in that they may include more than one hardware thread context (or "logical processor") per core. Processor 920 may be implemented as a complex instruction set computer (CISC) or a reduced instruction set computer (RISC) processor.

Memory 930 can be implemented using any suitable type of digital storage including, for example, flash memory and/or random access memory (RAM). In some embodiments, the memory 930 may include various layers of memory hierarchy and/or memory caches as are known to those of skill in the art. Memory 930 may be implemented as a volatile memory device such as, but not limited to, a RAM, dynamic RAM (DRAM), or static RAM (SRAM) device. Storage system 970 may be implemented as a non-volatile storage device such as, but not limited to, one or more of a hard disk drive (HDD), a solid-state drive (SSD), a universal serial bus (USB) drive, an optical disk drive, tape drive, an internal storage device, an attached storage device, flash memory, battery backed-up synchronous DRAM (SDRAM), and/or a network accessible storage device. In some embodiments, storage 970 may comprise technology to increase the storage performance enhanced protection for valuable digital media when multiple hard drives are included.

Processor 920 may be configured to execute an Operating System (OS) 980 which may comprise any suitable operating system, such as Google Android (Google Inc., Mountain View, Calif.), Microsoft Windows (Microsoft Corp., Redmond, Wash.), Apple OS X (Apple Inc., Cupertino, Calif.), Linux, or a real-time operating system (RTOS). As will be appreciated in light of this disclosure, the techniques provided herein can be implemented without regard to the particular operating system provided in conjunction with platform 810, and therefore may also be implemented using any suitable existing or subsequently-developed platform.

I/O system 950 may be configured to interface between various I/O devices and other components of platform 810. I/O devices may include, but not be limited to, user interface 960 and display element 962. User interface 960 may include other devices (not shown) such as a touchpad, keyboard, mouse, microphone and speaker, etc. I/O system 950 may include a graphics subsystem configured to perform processing of images for rendering on the display element 962. Graphics subsystem may be a graphics processing unit or a visual processing unit (VPU), for example. An analog or digital interface may be used to communicatively couple graphics subsystem and the display element. For example, the interface may be any of a high definition multimedia interface (HDMI), DisplayPort, wireless HDMI, and/or any other suitable interface using wireless high definition compliant techniques. In some embodiments, the graphics subsystem could be integrated into processor 920 or any chipset of platform 810.

It will be appreciated that in some embodiments, the various components of platform 810 may be combined or integrated in a system-on-a-chip (SoC) architecture. In some embodiments, the components may be hardware components, firmware components, software components or any suitable combination of hardware, firmware or software.

Antenna panel 102 is configured to provide long wavelength electrical current paths in a reduced size form factor, using corrugated or folded sections, as previously described, to efficiently transmit and/or receive longer wavelength signals. Antenna panel 102 may include any or all of the components and features illustrated in FIGS. 1-7, as described above. These components can be implemented or otherwise used in conjunction with a variety of suitable software and/or hardware that is coupled to or that otherwise forms a part of platform 810. Transceiver 310 is configured to interface with antenna panel 102 to provide signal transmission and reception capabilities for the platform 810. In some embodiments, transceiver 310 may include RF components such as amplifiers, filters, mixers, and the like, to transform a baseband signal into an RF signal and vice versa.

Various embodiments may be implemented using hardware elements, software elements, or a combination of both. Examples of hardware elements may include processors, microprocessors, circuits, circuit elements (for example, transistors, resistors, capacitors, inductors, and so forth), integrated circuits, ASICs, programmable logic devices, digital signal processors, FPGAs, logic gates, registers, semiconductor devices, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces, instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power level, heat tolerances, processing cycle budget, input data rates, output data rates, memory resources, data bus speeds, and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

The various embodiments disclosed herein can be implemented in various forms of hardware, software, firmware, and/or special purpose processors. For example, in one embodiment at least one non-transitory computer readable storage medium has instructions encoded thereon that, when executed by one or more processors, cause one or more of the methodologies disclosed herein to be implemented. The instructions can be encoded using a suitable programming language, such as C, C++, object oriented C, Java, JavaScript, Visual Basic .NET, Beginner's All-Purpose Symbolic Instruction Code (BASIC), or alternatively, using custom or proprietary instruction sets. The instructions can be provided in the form of one or more computer software applications and/or applets that are tangibly embodied on a memory device, and that can be executed by a computer having any suitable architecture. In other embodiments, the functionalities disclosed herein can be incorporated into other applications including communications/telecommunications of various types. The computer software applications disclosed herein may include any number of different modules, sub-modules, or other components of distinct functionality, and can provide information to, or receive information from, still other components. Other componentry and functionality not reflected in the illustrations will be apparent in light of this disclosure, and it will be appreciated that other embodiments are not limited to any particular hardware or software configuration. Thus, in other embodiments platform 810 may comprise additional, fewer, or alternative subcomponents as compared to those included in the example embodiment of FIG. 9.

The aforementioned non-transitory computer readable medium may be any suitable medium for storing digital information, such as a hard drive, a server, a flash memory, and/or random access memory (RAM), or a combination of memories. In alternative embodiments, the components and/or modules disclosed herein can be implemented with hardware, including gate level logic such as a field-programmable gate array (FPGA), or alternatively, a purpose-built semiconductor such as an application-specific integrated circuit (ASIC). In some embodiments, the hardware may be modeled or developed using hardware description languages such as, for example Verilog or VHDL. Still other embodiments may be implemented with a microcontroller having a number of input/output ports for receiving and outputting data, and a number of embedded routines for carrying out the various functionalities disclosed herein. It will be apparent that any suitable combination of hardware, software, and firmware can be used, and that other embodiments are not limited to any particular system architecture.

Some embodiments may be implemented, for example, using a machine readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, process, or the like, and may be implemented using any suitable combination of hardware and/or software. The machine readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CD-RW) memory, optical disk, magnetic media, magneto-optical media, removable memory cards or disks, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smart phones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

One example embodiment of the present disclosure provides a panel antenna. The panel antenna includes: a first antenna arm comprising one or more corrugated sections between a distal end and a proximal end of the first antenna arm, wherein the proximal end of the first antenna arm is coupled to a connection port, and the corrugated sections are to increase the electrical length of the panel antenna within fixed physical dimensions of the panel antenna; a second antenna arm comprising one or more additional corrugated sections between a distal end and a proximal end of the second antenna arm, wherein the proximal end of the second antenna arm is coupled to the connection port; a first set of filters to couple the distal ends of the first and second antenna arms to the ground plane, the first set of filters to enable signal currents in a first frequency range to flow in a first loop; and a second set of filters to couple a first location between the distal and proximal ends of the first antenna arm to a second location between the distal and proximal ends of the second antenna arm, the second set of filters to enable signal currents in a second frequency range to flow in a second loop, wherein the first frequency range is lower than the second frequency range, and the second loop is shorter than the first loop.

In some cases, the first loop comprises the ground plane, a path from the distal end to the proximal end of the first antenna arm, and a path from the distal end to the proximal end of the second antenna arm; and the second loop comprises a path from the first location to the second location. In some cases, the first set of filters and the second set of filters are passive filters with low loss characteristics to reduce resonance. In some cases, the first set of filters provide resistive coupling of the distal ends of the first and second antenna arms to the ground plane to control voltage standing wave ratio. In some cases, the antenna panel further includes a ferrite plane, disposed between the ground plane and the antenna arms, to reduce reflections and allow for a reduced antenna profile. In some cases, the antenna panel further includes at least one of a transmitter and a receiver, coupled to the antenna through the connection port. In some cases, the proximal ends of the first and second antenna arms taper down to a reduced dimension to match an impedance of the connection port. In some cases, the first frequency range and the second frequency range are in the range of 30 to 300 Megahertz. In some cases, the distance from the distal end to the proximal end of the first and the second antenna arms is one quarter of a longest wavelength signal of interest. In some cases, the antenna panel further includes a third set of filters to couple a third location between the first location and the proximal end of the first antenna arm to a fourth location between the second location and the proximal end of the second antenna arm, the third set of filters to enable signal currents in a third frequency range to flow in a third loop, wherein the second frequency range is lower than the third frequency range, and the third loop is shorter than the second loop.

Another example embodiment of the present disclosure provides a transmitter system. The transmitter system includes: a radio frequency (RF) source to generate a signal to be transmitted, the RF source coupled to a connection port of a panel antenna. The panel antenna includes: a ground plane; a first antenna arm comprising one or more corrugated sections between a distal end and a proximal end of the first antenna arm, wherein the proximal end of the first antenna arm is coupled to the connection port, and the corrugated sections are to increase the electrical length of the panel antenna within fixed physical dimensions of the panel antenna; a second antenna arm comprising one or more additional corrugated sections between a distal end and a proximal end of the second antenna arm, wherein the proximal end of the second antenna arm is coupled to the connection port; a first set of filters to couple the distal ends of the first and second antenna arms to the ground plane, the first set of filters to enable signal currents in a first frequency range to flow in a first loop; and a second set of filters to couple a first location between the distal and proximal ends of the first antenna arm to a second location between the distal and proximal ends of the second antenna arm, the second set of filters to enable signal currents in a second frequency range to flow in a second loop, wherein the first frequency range is lower than the second frequency range, and the second loop is shorter than the first loop.

In some cases, the first loop comprises the ground plane, a path from the distal end to the proximal end of the first antenna arm, and a path from the distal end to the proximal end of the second antenna arm; and the second loop comprises a path from the first location to the second location. In some cases, the first set of filters and the second set of filters are passive filters with low loss characteristics to reduce resonance. In some cases, the first set of filters provide resistive coupling of the distal ends of the first and second antenna arms to the ground plane to control voltage standing wave ratio. In some cases, the panel antenna further includes a ferrite plane, disposed between the ground plane and the antenna arms, to reduce reflections and allow for a reduced antenna profile.

Another example embodiment of the present disclosure provides a receiver system. The receiver system includes: a radio frequency (RF) front end circuit to receive a signal from a panel antenna, the RF front end circuit coupled to a connection port of the panel antenna. The panel antenna includes: a ground plane; a first antenna arm comprising one or more corrugated sections between a distal end and a proximal end of the first antenna arm, wherein the proximal end of the first antenna arm is coupled to the connection port, and the corrugated sections are to increase the electrical length of the panel antenna within fixed physical dimensions of the panel antenna; a second antenna arm comprising one or more additional corrugated sections between a distal end and a proximal end of the second antenna arm, wherein the proximal end of the second antenna arm is coupled to the connection port; a first set of filters to couple the distal ends of the first and second antenna arms to the ground plane, the first set of filters to enable signal currents in a first frequency range to flow in a first loop; and a second set of filters to couple a first location between the distal and proximal ends of the first antenna arm to a second location between the distal and proximal ends of the second antenna arm, the second set of filters to enable signal currents in a second frequency range to flow in a second loop, wherein the first frequency range is lower than the second frequency range, and the second loop is shorter than the first loop.

In some cases, the first loop comprises the ground plane, a path from the distal end to the proximal end of the first antenna arm, and a path from the distal end to the proximal end of the second antenna arm; and the second loop comprises a path from the first location to the second location. In some cases, the first set of filters and the second set of filters are passive filters with low loss characteristics to reduce resonance. In some cases, the first set of filters provide resistive coupling of the distal ends of the first and second antenna arms to the ground plane to control voltage standing wave ratio. In some cases, the ferrite plane is disposed between the ground plane and the antenna arms, to reduce reflections and allow for a reduced antenna profile.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not be this detailed description, but rather by the claims appended hereto. Future filed applications claiming priority to this application may claim the disclosed subject matter in a different manner, and may generally include any set of one or more elements as variously disclosed or otherwise demonstrated herein.

What is claimed is:

1. A panel antenna comprising:

a ground plane;

a first antenna arm comprising one or more corrugated sections between a distal end and a proximal end of the first antenna arm, wherein the proximal end of the first antenna arm is coupled to a connection port, and the corrugated sections are to increase the electrical length of the panel antenna within fixed physical dimensions of the panel antenna;

a second antenna arm comprising one or more additional corrugated sections between a distal end and a proximal end of the second antenna arm, wherein the proximal end of the second antenna arm is coupled to the connection port;

a first set of filters to couple the distal ends of the first and second antenna arms to the ground plane, the first set of filters to enable signal currents in a first frequency range to flow in a first loop; and a second set of filters to couple a first location between the distal and proximal ends of the first antenna arm to a second location between the distal and proximal ends of the second antenna arm, the second set of filters to enable signal currents in a second frequency range to flow in a second loop, wherein the first frequency range is lower than the second frequency range, and the second loop is shorter than the first loop.

2. The antenna of claim 1, wherein the first loop comprises the ground plane, a path from the distal end to the proximal end of the first antenna arm, and a path from the distal end to the proximal end of the second antenna arm; and the second loop comprises a path from the first location to the second location.

3. The antenna of claim 1, wherein the first set of filters and the second set of filters are passive filters with low loss characteristics to reduce resonance.

4. The antenna of claim 1, wherein the first set of filters provide resistive coupling of the distal ends of the first and second antenna arms to the ground plane to control voltage standing wave ratio.

5. The antenna of claim 1, further comprising a ferrite plane, disposed between the ground plane and the antenna arms, to reduce reflections and allow for a reduced antenna profile.

6. The antenna of claim 1, further comprising at least one of a transmitter and a receiver, coupled to the antenna through the connection port.

7. The antenna of claim 1, wherein the proximal ends of the first and second antenna arms taper down to a reduced dimension to match an impedance of the connection port.

8. The antenna of claim 1, wherein the first frequency range and the second frequency range are in the range of 30 to 300 Megahertz.

9. The antenna of claim 1, wherein the distance from the distal end to the proximal end of the first and the second antenna arms is one quarter of a longest wavelength signal of interest.

10. The antenna of claim 1, further comprising a third set of filters to couple a third location between the first location and the proximal end of the first antenna arm to a fourth location between the second location and the proximal end of the second antenna arm, the third set of filters to enable signal currents in a third frequency range to flow in a third loop, wherein the second frequency range is lower than the third frequency range, and the third loop is shorter than the second loop.

11. The system of claim 10, wherein the first loop comprises the ground plane, a path from the distal end to the proximal end of the first antenna arm, and a path from the distal end to the proximal end of the second antenna arm; and the second loop comprises a path from the first location to the second location.

12. The system of claim 10, wherein the first set of filters and the second set of filters are passive filters with low loss characteristics to reduce resonance.

13. The system of claim 10, wherein the first set of filters provide resistive coupling of the distal ends of the first and second antenna arms to the ground plane to control voltage standing wave ratio.

14. The system of claim 10, further comprising a ferrite plane, disposed between the ground plane and the antenna arms, to reduce reflections and allow for a reduced antenna profile.

15. A transmitter system comprising:

a radio frequency (RF) source to generate a signal to be transmitted, the RF source coupled to a connection port of a panel antenna;

the panel antenna comprising:

a ground plane;

a first antenna arm comprising one or more corrugated sections between a distal end and a proximal end of the first antenna arm, wherein the proximal end of the first antenna arm is coupled to the connection port, and the corrugated sections are to increase the electrical length of the panel antenna within fixed physical dimensions of the panel antenna;

a second antenna arm comprising one or more additional corrugated sections between a distal end and a proximal end of the second antenna arm, wherein the proximal end of the second antenna arm is coupled to the connection port;

a first set of filters to couple the distal ends of the first and second antenna arms to the ground plane, the first set of filters to enable signal currents in a first frequency range to flow in a first loop; and a second set of filters to couple a first location between the distal and proximal ends of the first antenna arm to a second location between the distal and proximal ends of the second antenna arm, the second set of filters to enable signal currents in a second frequency range to flow in a second loop, wherein the first frequency range is lower than the second frequency range, and the second loop is shorter than the first loop.

16. A receiver system comprising:

a radio frequency (RF) front end circuit to receive a signal from a panel antenna, the RF front end circuit coupled to a connection port of the panel antenna;

the panel antenna comprising:

a ground plane;

a first antenna arm comprising one or more corrugated sections between a distal end and a proximal end of the first antenna arm, wherein the proximal end of the first antenna arm is coupled to the connection port, and the corrugated sections are to increase the electrical length of the panel antenna within fixed physical dimensions of the panel antenna;

a second antenna arm comprising one or more additional corrugated sections between a distal end and a proximal end of the second antenna arm, wherein the proximal end of the second antenna arm is coupled to the connection port;

a first set of filters to couple the distal ends of the first and second antenna arms to the ground plane, the first set of filters to enable signal currents in a first frequency range to flow in a first loop; and a second set of filters to couple a first location between the distal and proximal ends of the first antenna arm to a second location between the distal and proximal ends of the second antenna arm, the second set of filters to enable signal currents in a second frequency range to flow in a second loop, wherein the first frequency range is lower than the second frequency range, and the second loop is shorter than the first loop.

17. The system of claim 16, wherein the first loop comprises the ground plane, a path from the distal end to the proximal end of the first antenna arm, and a path from the distal end to the proximal end of the second antenna arm; and the second loop comprises a path from the first location to the second location.

18. The system of claim 16, wherein the first set of filters and the second set of filters are passive filters with low loss characteristics to reduce resonance.

19. The system of claim 16, wherein the first set of filters provide resistive coupling of the distal ends of the first and second antenna arms to the ground plane to control voltage standing wave ratio.

20. The system of claim 16, further comprising a ferrite plane, disposed between the ground plane and the antenna arms, to reduce reflections and allow for a reduced antenna profile.

* * * * *